US010920355B2

(12) United States Patent
Kim et al.

(10) Patent No.: US 10,920,355 B2
(45) Date of Patent: Feb. 16, 2021

(54) GARMENT PROCESSING APPARATUS AND METHOD OF CONTROLLING GARMENT PROCESSING APPARATUS

(71) Applicant: LG ELECTRONICS INC., Seoul (KR)

(72) Inventors: Kayeon Kim, Seoul (KR); Jaehyun Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 16/572,925

(22) Filed: Sep. 17, 2019

(65) Prior Publication Data

US 2020/0010995 A1 Jan. 9, 2020

Related U.S. Application Data

(63) Continuation of application No. 15/553,355, filed as application No. PCT/KR2016/002132 on Mar. 3, 2016, now Pat. No. 10,458,055.

(30) Foreign Application Priority Data

Mar. 3, 2015 (KR) ..... 10-2015-0029772

(51) Int. Cl.

| | |
|---|---|
| ***D06F 33/48*** | (2020.01) |
| ***D06F 33/00*** | (2020.01) |
| ***D06F 37/24*** | (2006.01) |
| ***D06F 37/20*** | (2006.01) |

(52) U.S. Cl.
CPC ..... *D06F 33/00* (2013.01); *D06F 37/203* (2013.01); *D06F 37/245* (2013.01)

(58) Field of Classification Search
CPC ..... D06F 18/00; D06F 33/00; D06F 37/203; D06F 37/22; D06F 37/225; D06F 37/24; D06F 37/245; D06F 39/00; D06F 2202/10; D06F 2204/00–2204/10; D06F 2220/00
See application file for complete search history.

(56) References Cited

U.S. PATENT DOCUMENTS

| | | | |
|---|---|---|---|
| 2012/0017646 | A1 | 1/2012 | Chae et al. |
| 2014/0223969 | A1 | 8/2014 | Kim et al. |

FOREIGN PATENT DOCUMENTS

| | | |
|---|---|---|
| KR | 20-1997-0058462 | 11/1997 |
| KR | 10-2001-0097015 | 11/2001 |
| KR | 10-2004-0026355 | 3/2004 |
| KR | 10-2005-0050262 | 5/2005 |

(Continued)

OTHER PUBLICATIONS

International Search Report and Report and Written Opinion dated May 12, 2016 issued in Application No. PCT/KR2016/002132 (with English translation).

(Continued)

*Primary Examiner* — Jason Y Ko
(74) *Attorney, Agent, or Firm* — Ked & Associates LLP

(57) ABSTRACT

The present invention relates to a garment processing apparatus which comprises: a tub rotatably supporting a drum for storing garments; a driving part or unit for rotating the drum; a magnetic force generating part provided on either one of the drum and the tub to generate magnetic force; and a signal generating part provided on the remaining one of the drum and the tub to generate different signals based on magnetic force that changes according to the position of the magnetic force generating part.

20 Claims, 6 Drawing Sheets

(56) References Cited

FOREIGN PATENT DOCUMENTS

| | | |
|---|---|---|
| KR | 10-2005-0102921 | 10/2005 |
| KR | 10-2010-0116325 | 11/2010 |

OTHER PUBLICATIONS

U.S. Office Action issued in U.S. Appl. No. 15/553,355 dated Dec. 13, 2018.
U.S. Office Action issued in U.S. Appl. No. 15/553,355 dated Apr. 9, 2019.
U.S. notice of Allowance issued in U.S. Appl. No. 15/553,355 dated Jun. 19, 2019.

(a)

(b)

(a)

(b)

(a)

(b)

GARMENT PROCESSING APPARATUS AND METHOD OF CONTROLLING GARMENT PROCESSING APPARATUS

CROSS-REFERENCE TO RELATED APPLICATIONS

This application is a Divisional Application of prior U.S. patent application Ser. No. 15/553,355 filed Aug. 24, 2017, which is a U.S. National Phase Application under 35 U.S.C. § 371 of International Application PCT/KR2016/002132 filed on Mar. 3, 2016, which claims the benefit of Korean Application No. 10-2015-0029772, filed Mar. 3, 2015, whose entire disclosures are hereby incorporated by reference.

TECHNICAL FIELD

The present invention relates to a garment processing apparatus (a laundry treating apparatus) and a method of controlling garment processing apparatus (a method of controlling the laundry treating apparatus).

BACKGROUND ART

A conventional laundry treating apparatus includes a cabinet forming an external appearance, a tub provided inside the cabinet, a drum rotatably provided inside the tub to wash laundry, and a motor of which rotary shaft is fixed to the drum by passing through the tub to rotate the drum.

The drum may be rotated without maintaining dynamic equilibrium depending on a position of laundry stored therein.

Dynamic equilibrium means 'the state that a centrifugal force or a moment made by the centrifugal force is 0 with respect to a rotary shaft when a rotor is rotated'. In case of a rigid body, if mass distribution of the rigid body is uniformly maintained around the rotary shaft, dynamic equilibrium is maintained.

Therefore, dynamic equilibrium in the laundry treating apparatus may be understood that mass distribution of laundry is within an allowable range around the rotary shaft of the drum when the drum is rotated in a state that laundry is stored in the drum (the case that the drum is rotated while being vibrated within the allowable range).

In contrast, the state that dynamic equilibrium has been broken (i.e., unbalance) in the laundry treating apparatus means that mass distribution is not maintained uniformly around the rotary shaft of the drum when the drum is rotated. This unbalance is generated when laundry is not distributed uniformly inside the drum.

If the drum of the unbalance state is rotated, the drum is vibrated, and the vibration of the drum is delivered to the tub or the cabinet, whereby a problem occurs in that noise is caused.

The conventional laundry treating apparatus includes balancing units to solve unbalance of the drum. The balancing units provided in the conventional laundry treating apparatus are ball balancers or fluid balancers having a ball or a fluid received in a housing fixed to the drum.

The ball balancer or the fluid balancer included in the conventional laundry treating apparatus functions to control unbalance by moving the ball or the fluid to an opposite side of a direction where laundry causing unbalance is located when a rotation track of the drum wobbles by means of the laundry causing unbalance.

However, the aforementioned unbalance control is useful for a steady state that vibration of the drum is within a certain range, whereas a problem occurs in that the unbalance control is not effective at a transient vibration state of the drum. Also, the conventional balancing unit has a structure that it is difficult to immediately solve unbalance (actively solve unbalance) when unbalance is generated.

DISCLOSURE

Technical Problem

An object of the present invention is to provide a laundry treating apparatus and a method of controlling the same, which may determine whether a drum is rotated at an unbalance state that laundry is not distributed uniformly.

Another object of the present invention is to provide a laundry treating apparatus and a method of controlling the same, in which a drum may be prevented from colliding with a tub.

Other object of the present invention is to provide a laundry treating apparatus and a method of controlling the same, in which unbalance may be solved actively.

Technical Solution

To achieve these objects and other advantages and in accordance with the purpose of the invention, the present invention provides a laundry treating apparatus comprising a drum in which laundry is stored; a tub for rotatably supporting the drum; a driving unit for rotating the drum; a magnetic force generator provided in any one of the drum and the tub to generate a magnetic force; and a signal generator provided in the other one of the drum and the tub to generate different signals based on the magnetic force varied depending on a position of the magnetic force generator.

The magnetic force generator and the signal generator may be provided to be spaced apart from each other at a predetermined distance along a height direction of the drum or provided to be spaced apart from each other at a predetermined distance along a direction parallel with a diameter direction of the drum.

The laundry treating apparatus may further comprise a controller for controlling an operation of the driving unit in accordance with a signal provided by the signal generator while the drum is being rotated.

The controller may lower RPM of the drum or stop rotation of the drum by controlling the driving unit if it is determined that the magnetic force of the magnetic force generator, which is sensed by the signal generator, gets out of a preset reference range.

The magnetic force generator may include permanent magnets fixed to the drum, the signal generator may include a sensor for generating a greater voltage signal if the permanent magnets are close to one another, and the controller may lower RPM of the drum or stop rotation of the drum by controlling the driving unit when a voltage signal sensed by the signal generator is the reference value or more.

The driving unit may include a stator fixed to the tub, forming a rotating magnetic field; a rotor rotated by the rotating magnetic field; a rotary shaft provided to pass through the tub to connect the drum with the rotor and provided along a direction vertical to a ground.

The laundry treating apparatus may further comprise a ring shaped housing fixed to the drum; a plurality of storage units or chambers provided inside the housing to provide a space where washing water is stored and provided to be partitioned from each other; an inlet for allowing the washing water to enter each of the storage units; a discharge inlet for discharging the washing water inside each of the storage units to the drum; and a housing water supply unit for supplying the washing water to the inlet.

The magnetic force generator may be provided in each of the storage units, or provided in a part of the storage units, wherein the magnetic force generators may be spaced apart from one another at a constant interval.

The laundry treating apparatus may further comprise a tub inlet provided to pass through the tub, into which laundry is put; and a drum inlet provided to pass through the drum and communicated with the tub inlet, wherein the housing may be fixed to any one of the drum inlet, a circumferential surface of the drum and the bottom of the drum.

The present invention provides a method of controlling a laundry treating apparatus, which comprises a drum in which laundry is stored, a tub for rotatably supporting the drum, a driving unit for rotating the drum, a magnetic force generator provided in any one of the drum and the tub to generate a magnetic force, and a signal generator provided in the other one of the drum and the tub to generate different signals depending on the magnetic force of the magnetic force generator, the method comprising the steps of rotating the drum at a preset reference RPM through the driving unit; stopping an operation of the driving unit if the magnetic force sensed by the signal generator gets out of a preset reference range; supplying washing water to the tub through water supply units and rotating the drum at RPM different from the reference RPM through the driving unit; draining the washing water stored in the tub; and rotating the drum at the reference RPM through the driving unit.

Advantageous Effects

According to the present invention, a laundry treating apparatus and a method of controlling the same may be provided, which may determine whether a drum is rotated at an unbalance state that laundry is not distributed uniformly.

Also, according to the present invention, a laundry treating apparatus and a method of controlling the same may be provided, in which a drum may be prevented from colliding with a tub.

Also, according to the present invention, a laundry treating apparatus and a method of controlling the same may be provided, in which unbalance may be solved actively.

BEST MODE FOR CARRYING OUT THE INVENTION

Reference will now be made in detail to the preferred embodiments of the present invention, examples of which are illustrated in the accompanying drawings. Meanwhile, elements or control method of apparatuses which will be described below are only intended to describe the embodiments of the present invention and are not intended to restrict the scope of the present invention. Wherever possible, the same reference numbers will be used throughout the drawings to refer to the same or like parts.

Figure 1:
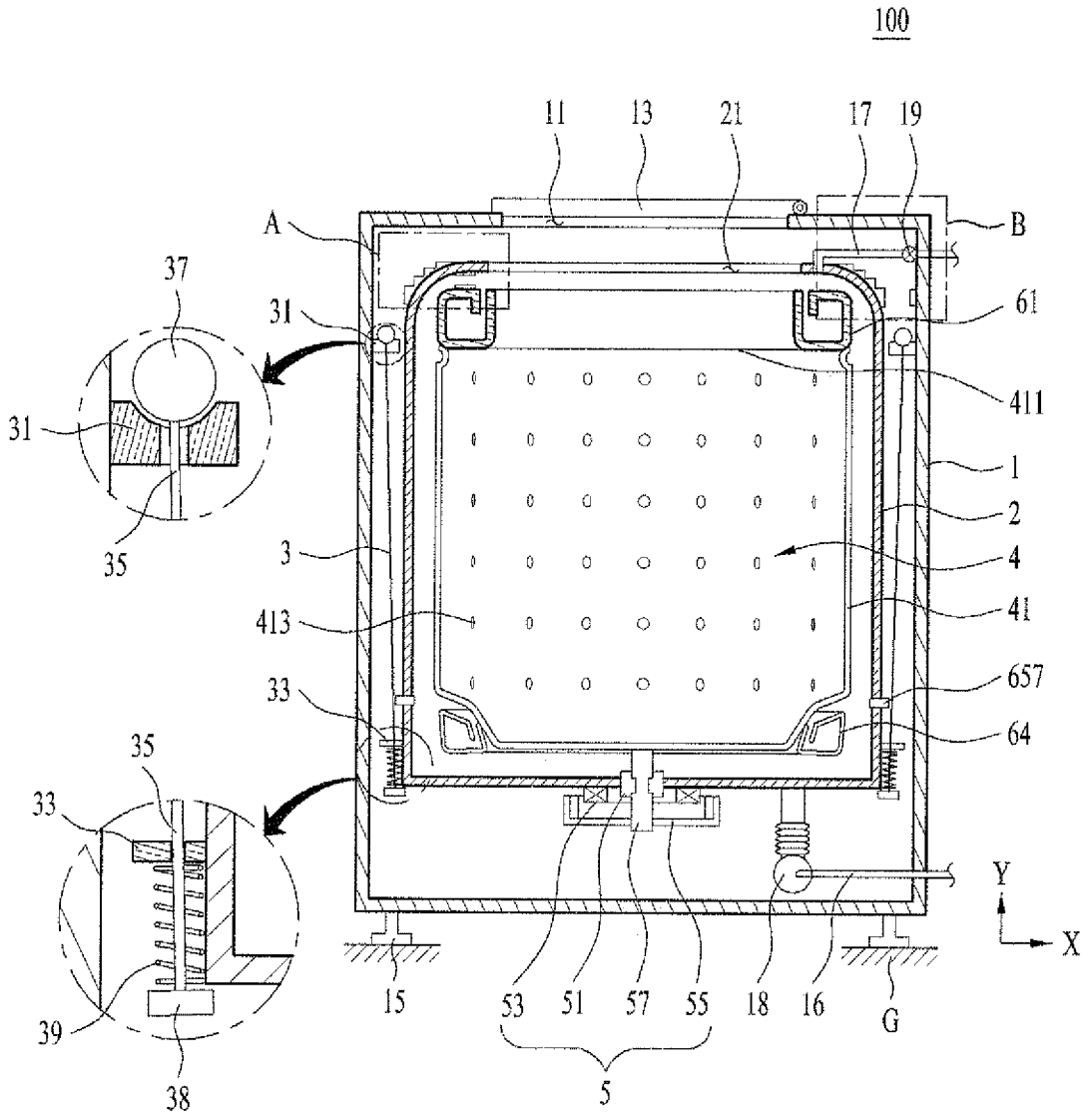
FIG. 1 illustrates an example of a laundry treating apparatus according to the present invention.

As shown in FIG. 1, a laundry treating apparatus 100 according to the present invention includes a cabinet 1 for forming an external appearance, a tub 2 provided inside the cabinet 1, storing washing water therein, a drum 4 provided inside the tub 2, for receiving laundry therein, and a driving unit 5 for rotating the drum 4.

The cabinet 1 includes an inlet 11 for supplying laundry to the drum 4 or taking the laundry stored in the drum out of the drum 4, and the inlet 11 includes a door 13 rotatably provided in the cabinet 1.

A control unit 15 may be provided on the bottom of the cabinet 1. The control unit 15 is a means for supporting the cabinet 1 on the ground G (bottom surface of a space where the laundry treating apparatus will be installed), and a user may control a height or level of the cabinet 1 through the control unit 15.

The tub 2 may be provided in all shapes that may store washing water. The washing water may be supplied to the tub 2 through water supply units 17 and 19, and the tub 2 discharges the washing water stored therein to the outside of the cabinet through drainage units 16 and 18.

The water supply units may include a water supply pipe 17 connected with a water supply source and a valve 19 for opening or closing the water supply pipe 17 in accordance with a control command of a controller (not shown), and the drainage units may include a pump 18 for discharging the washing water in the tub 2 to the outside of the tub 2, and a drainage pipe 16 for guiding the water pressurized by the pump to the outside of the cabinet 1.

The tub 2 includes a tub inlet 21 communicated with the inlet 11, and may be fixed into the cabinet 1 through a tub support unit 3. The tub support unit 3 is preferably provided in a structure that may absorb vibration generated in the tub 2.

That is, the tub support unit 3 may include a first support unit 31 provided in the cabinet 1, a second support unit 33 provided in the tub 2, and a connection unit 35 having one end connected to the first support unit and the other end connected to the second support unit.

The connection unit 35 may be provided as a bar coupled to the first support unit 31 through a mounting portion 37 and connected to the second support unit 33 through a flange 38 and a pressurizing unit 39.

The mounting portion 37 is provided in a spherical shape and mounted on a receiving groove of the first support unit 31, and the pressurizing unit 39 may be provided as a compression spring located between the flange 38 and the second support unit 33 to respectively pressurize the second support unit 33 and the flange 38.

Therefore, vibration of the tub 2 with respect to a direction Y (height direction of the drum) vertical to the ground may be attenuated by the pressurizing unit 39, and vibration of the tub 2 with respect to a plane (plane parallel with X-axis and plane parallel with a diameter direction of the drum) parallel with the ground G may be attenuated by the mounting portion 37 and the pressurizing unit 39.

The drum 4 may be provided as a body 41 located inside the tub 2 to receive laundry therein. Since the body 41 is rotated inside the tub by the driving unit 5, it is preferable that the body 41 is provided in a cylindrical shape.

A drum inlet 411 communicated with the tub inlet 21 may be provided in the body 41, and a through hole 413 for allowing the washing water supplied to the tub 2 to enter the body 41 may be provided on the circumferential surface of the body 41.

The drum inlet 411 may be provided in all shapes that may communicate the tub inlet 21 with the inside of the body 41. In FIG. 1, the drum unlet 411 is provided as an opening surface located on an upper surface of the body 41 as an example.

The aforementioned drum 4 is rotated inside the tub 2 by the driving unit 5.

The laundry treating apparatus 100 of the present invention may be provided in any one of a top loading type in which the inlet 11 is located on an upper surface of the cabinet 1 and a front loading type in which the inlet 11 is located on a front surface of the cabinet 1.

FIG. 1 illustrates that the laundry treating apparatus 100 of the present invention is a top loading type. In this case, the inlet 11, the tub inlet 21 and the drum inlet 411 should be provided on the upper surface of the cabinet 1, the upper surface of the tub 2, and the upper surface of the body 41, respectively.

Also, the driving unit 5 provided in the top loading type laundry treating apparatus may include a stator 53 fixed to an outer bottom of the tub 2, forming a rotating magnetic field, a rotor 55 rotated by the rotating magnetic field, a rotary shaft 58 provided to pass through the bottom of the tub 2, connecting the rotor 55 with the body 41, and a shaft support unit 51 provided in the tub, rotatably supporting the rotary shaft 57.

Meanwhile, if the laundry treating apparatus is provided in the front loading type, the inlet 11, the tub inlet 21 and the drum inlet 411 should be provided on the front surface of the cabinet 1, the tub 2 and the body 41, respectively. In this case, since the body 41 of the drum should be provided in such a manner that its rotation center is parallel with the ground G, the driving unit provided in the front loading type laundry treating apparatus should be provided with a stator fixed to an outer rear surface of the tub, a rotary shaft connecting the body with a rotor by passing through the rear surface of the tub, and a shaft support unit provided in the tub, rotatably supporting the rotary shaft.

In the laundry treating apparatus having the aforementioned structure, the controller supplies washing water to the tub 2 through the water supply units 17 and 19, and the driving unit 5 rotates the drum 4 to rub the laundry with the washing water, whereby the laundry is washed. Afterwards, the controller discharges the washing water to the outside of the tub through the drainage units 16 and 18 and dehydrates the laundry by rotating the drum 4 through the driving unit 4.

If the drum 4 is rotated in a state that the laundry is concentrated on a part of the drum without being distributed uniformly in the drum despite that the drum support unit 3 performs a function of attenuating vibration of the tub, an unbalance state that the drum is vibrated beyond an allowable range occurs in the drum 4. If the drum 4 of the unbalance state is rotated, vibration is generated in the drum 4, and vibration of the drum 4 is delivered to the tub 2 or the cabinet 1, whereby a problem occurs in that noise caused.

The laundry treating apparatus 100 of the present invention may include a sensor 7 to determine whether the drum 4 is in the unbalance state or may collide with the tub 2.

Figure 2:
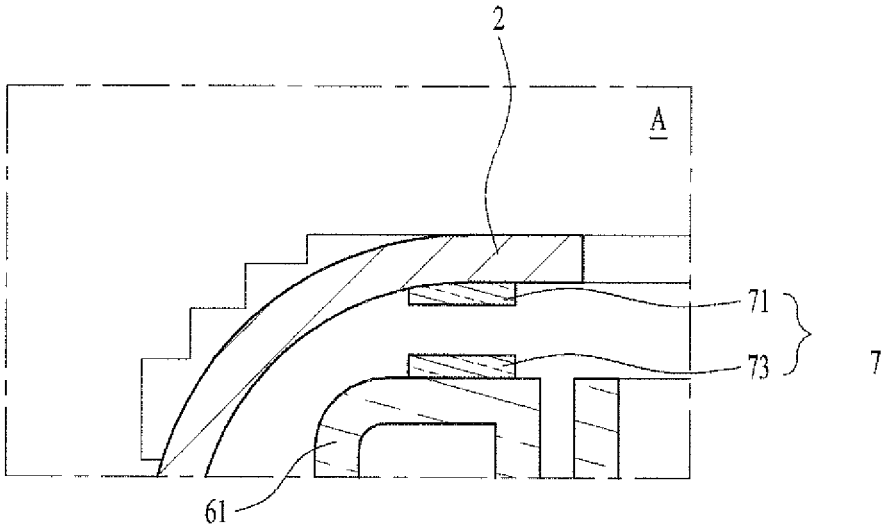
FIG. 2 illustrates an example of a sensor provided in the present invention.
Figure 2:
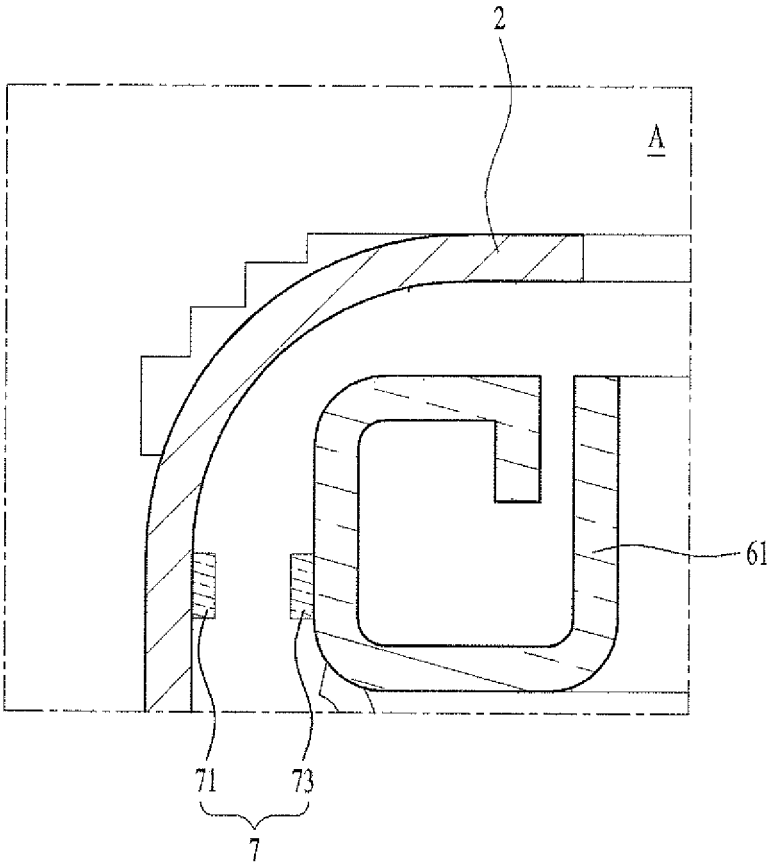

As shown in FIG. 2, the sensor 7 may include a magnetic force generator 73 provided in any one of the drum 4 and the tub 2, generating a magnetic force, and a signal generator 71 provided in the other one of the drum 4 and the tub 2, transmitting a signal, which is based on a magnetic force varied depending on the position of the magnetic force generator 73, to the controller.

The magnetic force generator 73 may be provided in all shapes that may generate a magnetic force, and its example may include a permanent magnet. The signal generator 71 may be provided in all shapes that may generate a signal proportional to or inverse proportional to the size of the magnetic force, and its example may include a sensor for generating a greater voltage signal if the magnetic force is greater.

In this case, the drum 4 is rotated by the driving unit 5, whereas the tub 2 is fixed by the tub support unit 3. In this respect, it is preferable that the signal generator 71 is provided in the tub 2 and the magnetic force generator 73 is fixed to the drum 4.

Meanwhile, the signal generator 71 and the magnetic force generator 73 may be arranged along a direction Y vertical to the ground, or may be arranged along a direction X parallel with the ground.

As shown in FIG. 2(*a*), if the signal generator 71 and the magnetic force generator 73 are arranged along a direction vertical to the ground, the signal generator 71 is preferably provided on the upper surface of the tub, where the tub inlet 21 is located, and the magnetic force generator 73 is preferably provided on the upper surface of the drum, where the drum inlet 411 is located.

Since the signal generator 71 is a means for transmitting a signal to the controller, it is preferable that the signal generator 71 is not in contact with the washing water stored in the tub 2. A maximum water level that may be supplied to the tub in the general top loading type laundry treating apparatus is lower than the height of the drum inlet 411. Therefore, the signal generator 71 may be provided in any area of the tub 2 if the signal generator 71 is higher than the drum inlet 411, and the upper surface of the tub is an example of an area where the signal generator may be located.

Meanwhile, since an amplitude of the drum 4 in the top loading type laundry treating apparatus becomes greater if it becomes far away from the rotary shaft 51, the upper end of the drum 4 corresponds to the portion where the amplitude of the drum 4 is the greatest in the top loading type laundry treating apparatus.

Therefore, if the signal generator 71 is provided to sense the magnetic force generator 73 located at the upper end of the drum (if the signal generator is provided to sense an upper end amplitude of the drum), it will be favorable when the controller determines whether unbalance is generated based on the signal transmitted from the signal generator 71 or collision between the drum and the tub is predicted.

If the sensor 7 is provided with one signal generator 71 provided in the tub and one magnetic force generator 73 provided in the drum, since the laundry is concentrated on an area of the outer circumference surface of the drum 4, where the magnetic force generator 73 is not located, it may be difficult to predict the case that the area of the drum 4 where the magnetic force generator 73 is not located collides with the tub. Therefore, it is preferable that either a plurality of signal generators 71 or a plurality of magnetic force generators 73 are provided.

That is, the signal generator 71 provided in the present invention may include a plurality of sensors (ex: three sensors spaced apart from one another at 120° and fixed to the tub) spaced apart from one another at a constant interval and fixed to the tub, and the magnetic force generator 73 may include a plurality of permanent magnets (ex: three permanent magnets spaced apart from one another at 120° and fixed to the outer circumference surface of the drum) spaced apart from one another at a constant interval and fixed to the drum.

If the signal generator 71 and the magnetic force generator 73 are arranged along a direction parallel with the ground (FIG. 2(*b*)), it is preferable that the signal generator 71 is located on an upper portion of the inner circumference surface of the tub and the magnetic force generator 73 is located on an upper portion of the outer circumference surface of the drum.

If the signal generator 71 and the magnetic force generator 73 are arranged along a direction parallel with the ground (FIG. 2(*b*)), it is likely to predict the possibility of collision between the drum and the tub more easily than the case that the signal generator 71 and the magnetic force generator 73 are arranged along the direction vertical to the ground (FIG. 2(*a*)).

The signal generator 71 may be provided to be fixed to the inner circumference surface of the tub and provided at a position (ex: balancer) higher than the drum inlet 411, and the magnetic force generator 73 may be fixed to the outer circumference surface of the drum corresponding to the height of the signal generator 71.

Even in this case, it is preferable that either a plurality of signal generators 71 or a plurality of magnetic force generators 73 are provided. Preferably, the magnetic force generator 73 fixed to the drum includes a plurality of permanent magnets spaced apart from one another at a constant interval.

If the drum 4 is rotated in a state that there is no unbalance in any case (the case that the signal generator 71 and the magnetic force generator 73 are arranged along a direction parallel with the ground or the case that the signal generator 71 and the magnetic force generator 73 are arranged along a direction vertical to the ground), since the magnetic force generator 73 fixed to the drum 4 will be rotated together with the drum 4, the signal generator 71 fixed to the tub 2 may sense a magnetic force within a reference range (or reference value) at a certain cycle (cycle varied depending on RPM of the drum).

However, if the drum is rotated in a state that there is unbalance, the signal generator 71 will sense a magnetic force beyond the reference range (or reference value). If it is determined that the size of the magnetic force sensed by the signal generator 71 is beyond the reference range, the controller (not shown) may stop the operation of the driving unit 5 or reduce RPM of the driving unit 5 (reduce RPM of the drum) to prevent collision between the drum 4 and the tub 2 from occurring.

If the signal generator 71 is provided as a sensor that generates a great voltage signal in proportion to the magnetic force of the magnetic force generator 73, the controller may stop the operation of the driving unit when the voltage signal sensed by the signal generator 71 exceeds a preset reference range or reference value.

Meanwhile, if it is determined that the signal transmitted from the signal generator 71 is beyond the reference range, to solve the unbalance, the controller (not shown) may supply the water to the tub 2 through the water supply units and then rotate the drum through the driving unit 5, thereby distributing the laundry stored in the drum 4.

To actively solve the unbalance state generated in the drum 4, the laundry treating apparatus 100 of the present invention may further include balancers 61 and 64 for temporarily storing externally supplied fluid to locally change a weight of the drum.

As shown in FIG. 1, the balancers may be provided as a first balancer 61 provided at the upper portion of the drum 4 and a second balancer 64 provided at the lower portion of the drum 4.

Figure 3:
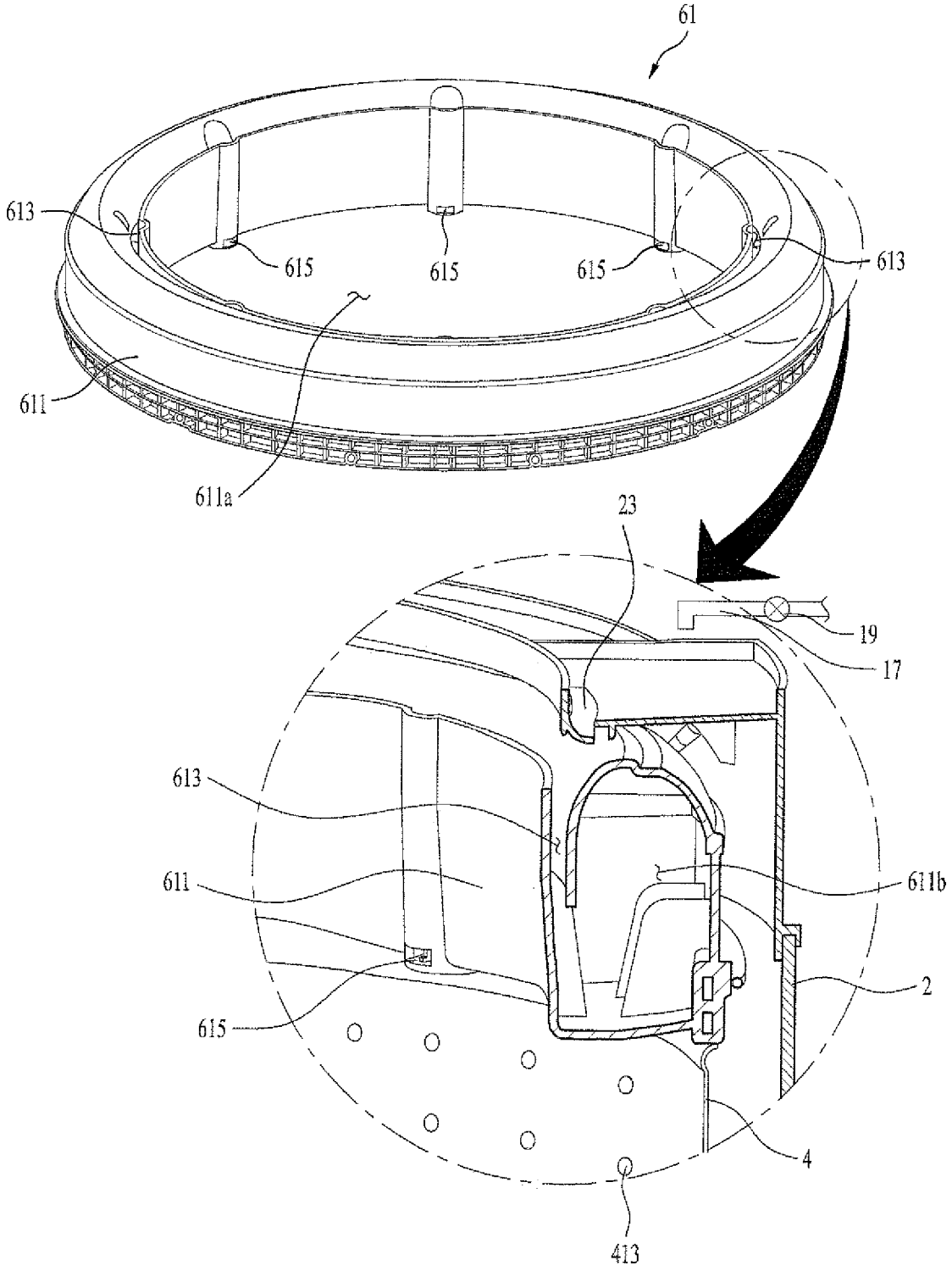
FIGS. 3 and 4 illustrate an example of a first balancer provided in the present invention.

As shown in FIG. 3, the first balancer 61 may include a first housing 611 fixed to the drum 4, storage units 611*b* provided inside the first housing, providing a space where the fluid is stored, a first inlet 613 for allowing the fluid to enter the storage units 611*b*, and a first discharge unit 615 discharging the fluid inside the storage units 611*b* to the outside of the storage units 611*b*.

Figure 4:
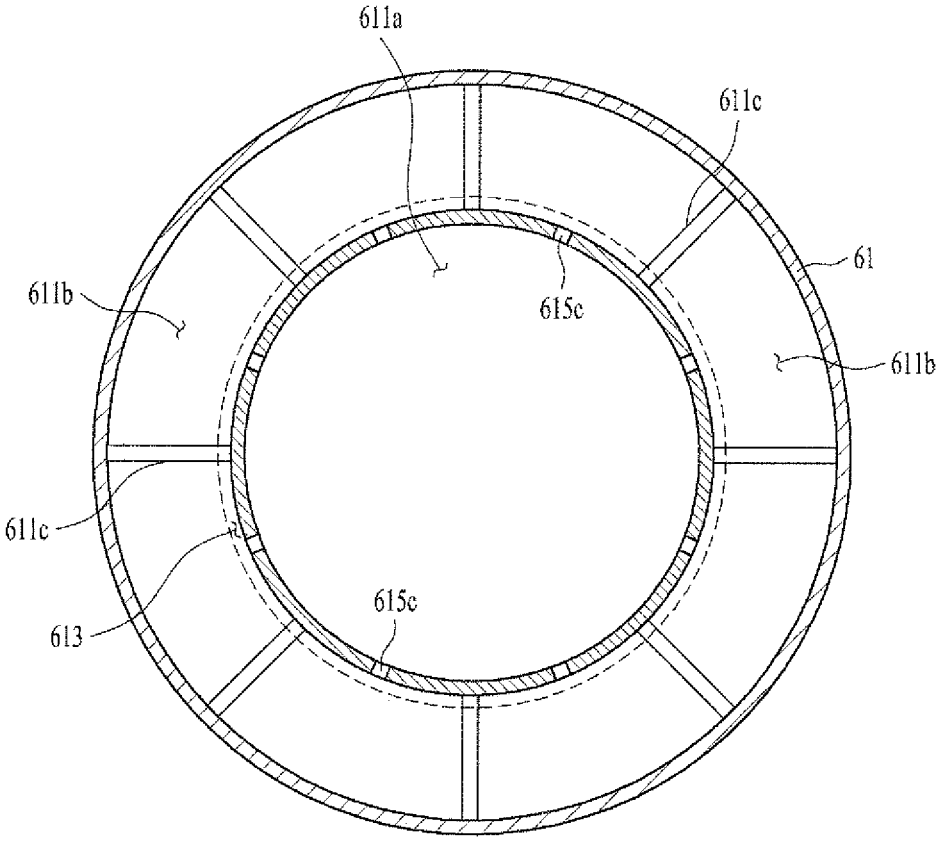
Figure 4:
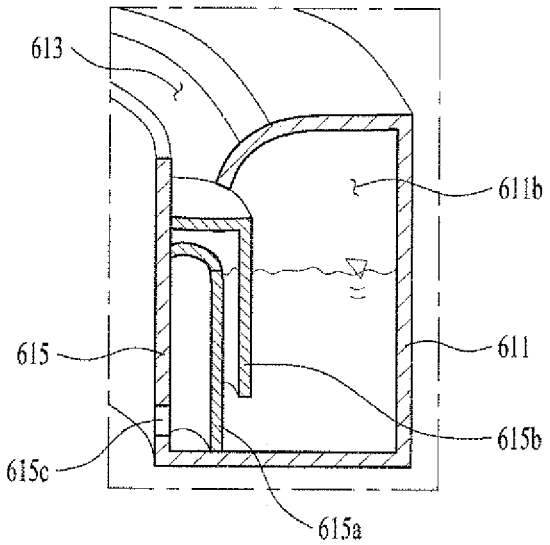

As shown in FIG. 4, since the first housing 611 should be provided so as not to cover the drum inlet 411, it is preferable that first housing 611 is provided in a ring shape to have a through hole 611*a* at the center.

At least two storage units 611*b* should be provided inside the first housing, and the respective storage units 611*b* should be partitioned from each other by a barrier 611*c*. The storage units 611*b* store the fluid supplied through the first inlet 613 provided to pass through the first housing 611.

Meanwhile, since the first housing 611 is fixed to the drum 4, the first housing 611 will be rotated together with the drum when the drum 4 is rotated. Therefore, it is preferable that the first inlet 613 is provided as a ring shaped slit passing through the upper surface of the first housing 611 along a circumferential direction of the through hole 611*a*.

The aforementioned first balancer supplies the fluid to the first inlet 613 through a first housing water supply unit. In this case, the water supply units 17 and 19 for supplying the washing water to the tub 2 may serve as the first housing water supply unit.

That is, as shown in FIG. 3, if the water supply pipe 17 is provided to supply the washing water to a guider 23 provided to pass through the upper surface of the tub and the first inlet 613 is located below the guider 23, the water supply pipe 17 may supply the fluid to the storage units 611*b* even while the first housing 611 is being rotated by the drum 4.

As shown in FIG. 4, the fluid supplied to each storage unit 611*b* may be discharged to the outside of the storage unit 611*b* through a first discharge unit 615.

FIG. 4(*a*) illustrates the first discharge unit for discharging the fluid stored in the storage units 611*b* only if the first housing 611 is not rotated by the drum 4, and FIG. 4(*b*) illustrates first discharge units for discharging the fluid inside the storage units 611*b* if the fluid stored in the storage units 611*b* exceeds a certain water level.

The first discharge unit 615 of FIG. 4(*a*) is a hole 615*c* provided to pass through the first housing 611, communicating the storage units 611*b* with the through hole 611*a*, and is provided along a direction toward the rotation center of the drum in an area of the first housing 611. Therefore, if the first housing 611 is rotated by the drum 4, the fluid supplied to the storage units 611*b* is not discharged to the outside of the storage units 611*b* by a centrifugal force. However, if the drum 4 stops its rotation or is rotated at RPM lower than a preset RPM, the fluid may be discharged to the drum 4 through the first discharge unit 615.

The first discharge units of FIG. 4(*b*) include a discharge pipe 615*a* extended from the bottom of the storage units 611*b* to the upper surface of the first housing 611, and a cover 615*b* extended from the first housing 611 to the discharge pipe 615*a*, covering a circumferential surface of the discharge pipe 615*a*.

The hole 615*c* communicating the storage units 611*b* with the outside is provided inside the discharge pipe 615*a*. The cover 615*b* is provided to surround an outer circumference surface of the discharge pipe 615*a*, is provided to be spaced apart from the bottom of the first housing 611 at a predetermined distance, and is provided so as not to be in contact with the upper end of the discharge pipe 615*a*. Therefore, the fluid inside the storage units 611*b* cannot be discharged to the outside of the storage units 611*b* until the water level inside the storage units 611*b* reaches the upper end of the discharge pipe 615*a*.

However, if the water level inside the storage units 611*b* reaches the upper end of the discharge pipe 615*a*, the fluid inside the storage unit 611*b* enters the upper end of the discharge pipe 615*a* through a space between the outer circumference surface of the discharge pipe 615*a* and the inner circumference surface of the cover 615*b* and then is discharged from the storage units 611*b* through the hole 615*c*.

Meanwhile, if the fluid of the storage units 611*b* starts to be discharged through the hole 615*c*, the fluid inside the storage units 611*b* will fully be discharged to the outside of the storage units 611*b* by a difference between a pressure inside the discharge pipe 615*a* and a pressure inside the storage units 611*b* (siphon).

The hole 615*c* may be provided to pass through a side of the first housing 611 as shown in FIG. 4(*b*), or may be provided to pass through the bottom of the first housing 611.

If the first balancer 61 is provided in the laundry treating apparatus of the present invention, the magnetic force generator 73 of the sensor 7 may be provided inside the storage units 611*b* of the first balancer. That is, the magnetic force generator 73 may be provided to be fixed to the bottom of the storage units 611*b* or the barrier 611*c* of the storage units 611*b*.

Meanwhile, if the position of the laundry, which causes unbalance, is determined, the controller should rotate the drum to supply the fluid to the storage units 611*b* located in an opposite direction of the position of the laundry that causes unbalance. Therefore, if a plurality of magnetic force generators 73 are provided in the storage units 611*b* of the first balancer, the signal generator 61 may sense the magnetic force generators 73 and transmit a signal to the controller, whereby the controller may easily determine a rotational angle of the drum through the signal transmitted from the signal generator 71.

In this case, the plurality of magnetic force generators 73 may be provided in all the respective storage units, or may be provided to be spaced apart from one another at a constant interval (ex: three permanent magnets spaced apart from one another at 120° and fixed to the storage units).

Figure 5:
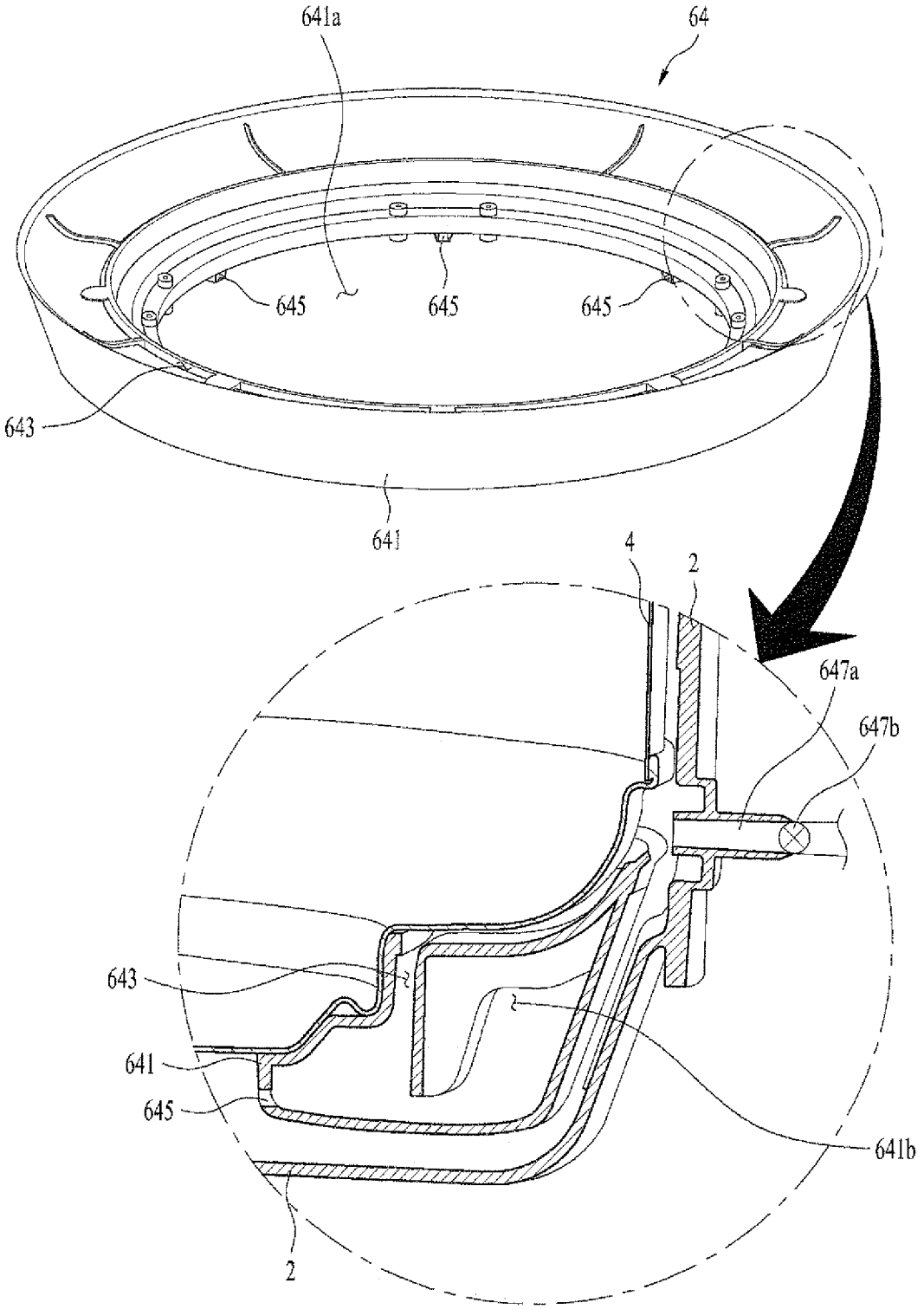
FIGS. 5 and 6 illustrate an example of a second balancer provided in the present invention.

As shown in FIG. 5, the second balancer 64 may include a second housing 641 fixed to the drum 4 and rotated together with the drum, storage units 641*b* provided inside the second housing, providing a space where the fluid is stored, a second inlet 643 for allowing the fluid to enter the storage units 641*b*, and a second discharge unit 645 discharging the fluid inside the storage units 641*b* to the outside of the storage units 641*b*.

Since the second housing 641 should be fixed to the bottom of the drum or the lower circumferential surface of the drum so as not to interfere with the driving unit 5, it is preferable that the second housing 641 is provided in a ring shape to have a through hole 641*a* at the center.

Figure 6:
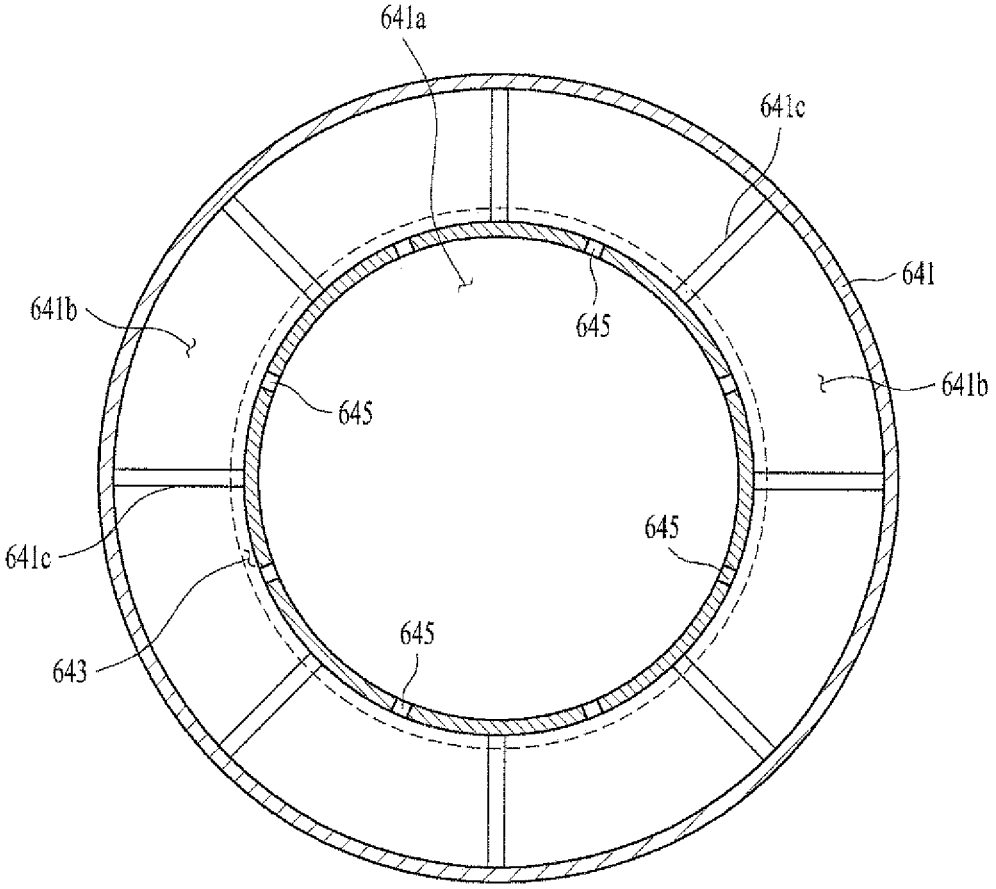
Figure 6:
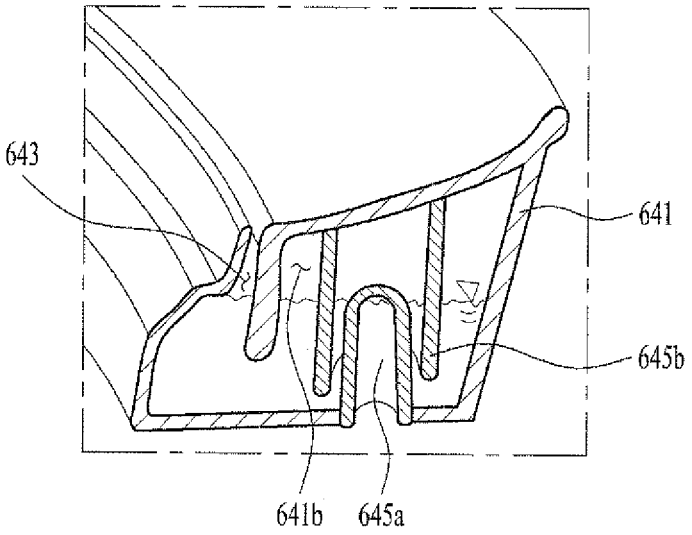

As shown in FIG. 6, at least two storage units 641*b* should be provided inside the second housing, and the respective storage units 641*b* should be partitioned from each other by a barrier 641*c*.

The fluid is supplied to the storage units 641*b* through the second inlet 643 provided to pass through the second housing 641. Meanwhile, the second housing 641 is rotated together with the drum 4 when the drum 4 is rotated, it is preferable that the second inlet 643 is provided in a ring shaped slit passing through the upper surface of the second housing 641 or a ring shaped slit passing through the side of the second housing 641.

As shown in FIG. 5, if the second inlet 643 is provided in a ring shaped slit passing through the upper surface of the second housing 641, a second housing water supply unit 657 should be provided to spray the fluid to a space between the bottom of the drum 4 and the upper surface of the second housing 641.

However, if the second inlet 643 is provided in a ring shaped slit passing through the side of the second housing 641, the second housing water supply unit 657 may be provided to directly spray the fluid toward the second inlet 643.

The second housing water supply unit 657 may include a second balancer water supply pipe 647*a* fixed to the tub 2, and a valve 647*b* for opening or closing the second balancer water supply pie through the controller. The second balancer water supply pipe 647*a* may directly be connected with an external water supply source, or may be connected with the water supply pipe 17.

As shown in FIG. 6, the fluid supplied to the storage units 641*b* of the second balancer may be discharged to the outside of the storage units 641*b* through a second discharge unit 645.

FIG. 6(*a*) illustrates the second discharge unit for discharging the fluid stored in the storage units 641*b* only if the second housing 641 is not rotated by the drum 4, and FIG. 6(*b*) illustrates second discharge units for discharging the fluid inside the storage units 641*b* if the fluid stored in the storage units 641*b* exceeds a certain water level.

The second discharge unit 645 of FIG. 6(*a*) is a hole 645*c* provided to pass through the second housing 641, communicating the storage units 641*b* with the through hole 641*a*, and is provided along a direction toward the rotation center of the drum.

Meanwhile, the second discharge unit shown in FIG. 6(*b*) includes a discharge pipe 645*a* extended from the bottom of the storage units 641*b* to the upper surface of the second housing 641, and a cover 645*b* extended from the second housing 641 to the discharge pipe 645*a*, covering a circumferential surface of the discharge pipe 645*a*.

The second discharge unit 645 shown in FIG. 6(*a*) discharges the fluid stored in the storage units 641*b* of the second balancer in the same manner as the first discharge unit 615 shown in FIG. 4(*a*), and the second discharge units 645*a*, 645*b* and 645*c* shown in FIG. 6(*b*) discharge the fluid stored in the storage units 641*b* of the second balancer in the same manner as the first discharge units 615*a*, 615*b* and 615*c* shown in FIG. 4*b*. Therefore, their detailed description will be omitted.

In the laundry treating apparatus 100 provided with the balancers 61 and 64 of the aforementioned structure, the controller (not shown) determines whether unbalance has been generated in the drum 4 and a position of laundry that causes unbalance, through the sensor 7 while the drum 4 is being rotated through the driving unit 5.

If it is determined that unbalance has been generated in the drum, based on the signal provided by the sensor 7, the controller supplies the fluid to the storage units 611*b* and 641*b* of each balancer located in an opposite direction of a direction where the laundry causing unbalance is located.

If the fluid is supplied to each of the storage units 611*b* and 641*b*, a weight of the drum in an opposite direction of a direction where the laundry causing unbalance is located is locally increased, whereby unbalance of the drum 4 may be solved.

Although the laundry treating apparatus 100 of the present invention may be provided to include both the first balancer 61 and the second balancer 64, the laundry treating apparatus may include only the first balancer 61 in that the bottom of the drum 4 is fixed to the rotary shaft 51 of the driving unit to generate an amplitude which is not great.

Hereinafter, a method of controlling the laundry treating apparatus having the aforementioned structure will be described.

If laundry is put into the drum 4, the controller supplies washing water to the tub 2 through the water supply units 17 and 19.

For washing of the laundry, the drum 4 should be rotated to rub the laundry with the washing water. Therefore, if water supply is completed, the controller rotates the drum 4 through the driving unit 5. When the drum is rotated for washing of the laundry, since the washing water is stored in the tub 2, the possibility of unbalance generated in the drum 4 is very low.

If washing of the laundry is completed, the controller drains the washing water inside the tub 2 through the drainage units 16 and 18 and then rotates the drum at a preset RPM (reference RPM) to dehydrate the laundry.

When the drum is rotated to dehydrate the laundry, since there is no washing water in the tub, the possibility of unbalance is very high depending on the position of the laundry. Therefore, the controller determines whether the signal provided by the signal generator 71 has gotten out of a preset reference range or exceeds a preset reference value while the drum 4 is being rotated at a reference RPM.

If it is determined that the signal provided by the signal generator 71 has gotten out of the reference range or the reference value, the controller lowers RPM of the drum 4 or stops rotation of the drum 4 by controlling the driving unit 5. Therefore, in the present invention, the drum 4 and the tub 2 may be prevented from colliding with each other.

Afterwards, in the present invention, a step for laundry distribution may be performed to solve unbalance, or the fluid may be supplied to the balancers 61 and 64 to solve unbalance.

The step for laundry distribution is the step of rotating the drum 4 through the driving unit 5 after supplying the washing water to the tub through the water supply units 17 and 19.

However, since the drum 4 does not need to be rotated at fast speed at the laundry distribution step, RPM of the drum at the laundry distribution step may be set to be smaller than the reference RPM. The laundry distribution step is completed if the drum alternately performs clockwise rotation and counterclockwise rotation for a preset time.

If the laundry distribution step is completed, the controller drains the washing water supplied to the tub for the laundry distribution step through the drainage units 16 and 18, If drainage is completed, the controller dehydrates the laundry by again rotating the drum at the reference RPM.

Meanwhile, if the fluid is supplied to the balancers 61 and 64 to control unbalance, the controller (not shown) supplies the fluid to the storage units 611*b* and 641*b* of each balancer located in an opposite direction of the direction where the laundry causing unbalance through the water supply units 17 and 19 and the second housing water supply unit 657.

If unbalance is solved by supply of the fluid to each of the balancers 61 and 64, the controller dehydrates the laundry by rotating the drum at the reference RPM.

The balancer having the first discharge unit of FIG. 4(*a*) and the second discharge unit of FIG. 6(*a*) should supply the fluid to each of the storage units 611*b* and 641*b* in a state that rotation of the drum is not stopped, and the fluid supplied to each of the storage units 611*b* and 641*b* will be discharged from each of the storage units 611*b* and 641*b* when rotation of the drum 4 is stopped.

However, the balancer having the first discharge unit of FIG. 4(*b*) and the second discharge unit of FIG. 6(*b*) may supply the fluid to each of the storage units 611*b* and 641*b* regardless of rotation of the drum, and the fluid supplied to each of the storage units 611*b* and 641*b* will be discharged from each of the storage units 611*b* and 641*b* the water supply units 17 and 19 and the second housing water supply unit 657 have only to additionally supply the fluid of a certain amount or more to each of the storage units 611*b* and 641*b*.

It will be apparent to those skilled in the art that the present invention may be embodied in other specific forms without departing from the spirit and essential characteristics of the invention. Thus, the above embodiments are to be considered in all respects as illustrative and not restrictive. The scope of the invention should be determined by reasonable interpretation of the appended claims and all change which comes within the equivalent scope of the invention are included in the scope of the invention.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method of controlling a laundry treating apparatus, the laundry treatment apparatus comprising a drum in which laundry is stored, a drum inlet provided at a first end of the drum, a tub for rotatably supporting the drum, a tub inlet provided at a first end of the tub and communicating with the drum inlet, a driving unit for rotating the drum, at least one permanent magnet provided in any one of the drum and the tub to generate a magnetic force, a signal generator provided in the other one of the drum and the tub to generate various signals based on the magnetic force varied depending on a position of the permanent magnet; and a controller for controlling an operation of the driving unit and a supply and a discharge of water to the tub via a water supply unit and a drainage unit, respectively, in accordance with a signal provided by the signal generator while the drum is being rotated, the method comprising:

rotating the drum at a first predetermined RPM through the driving unit;

sensing, via the signal generator, a magnetic force value of a magnetic force generated in the permanent magnet during rotation of the drum;

stopping an operation of the driving unit or rotating the drum at a second predetermined RPM which is lower than the first predetermined RPM if the sensed magnetic force value is outside of a predetermined magnetic force value reference range;

supplying water to and storing water in the tub through the water supply unit after stopping an operation of the driving unit or rotating the drum at the second predetermined RPM;

rotating the drum at a third predetermined RPM different from the first predetermined RPM through the driving unit;

draining the water stored in the tub through the drainage unit after rotating the drum at the third predetermined RPM for a predetermined time period; and rotating the drum at the first predetermined RPM through the driving unit.

2. The method of claim 1, wherein the magnetic force value is a voltage signal, and the predetermined magnetic force value range has a predetermined voltage range.

3. The method of claim 1, wherein the third predetermined RPM is lower than the first predetermined RPM.

4. The method of claim 3, wherein, when the drum is rotated at the third predetermined RPM, the drum is rotated alternately clockwise and counterclockwise for the predetermined time period.

5. A control method of a laundry treating apparatus, the laundry treating apparatus comprising a drum in which laundry is stored, a drum inlet provided at a first end of the drum, a tub for rotatably supporting the drum and having a tub inlet communicating with the drum inlet, a driving unit for rotating the drum, at least one permanent magnet provided in any one of the drum and the tub to generate a magnetic force, a signal generator provided in the other one of the drum and the tub to generate various signals based on the magnetic force varied depending on a position of the permanent magnet; a first balancer having a ring shape and fixed to one of the first end or the second end of the drum and including a plurality of storage chambers arranged to form the ring shape and configured to receive and store water to correct an unbalanced state of the drum; a controller for controlling an operation of the driving unit, a supply of water to the first balancer via an inlet for allowing the water to enter each of the storage chambers, and a discharge of water from the first balancer via an outlet for discharging the water inside each of the storage chambers to the drum, the controller controlling the operation, supply, and discharge in accordance with a signal generated by the signal generator while the drum is being rotated, and a housing water supply unit for supplying the water to the inlet, the method comprising:

rotating the drum at a first predetermined RPM via the driving unit;

sensing, via the signal generator, a magnetic force value of a magnetic force generated by the permanent magnet during rotation of the drum at the first predetermined RPM;

rotating the drum at a second predetermined RPM which is lower than the first predetermined RPM if the sensed magnetic force value is outside of a predetermined magnetic force value range;

supplying water to the first balancer after rotation of the drum at the second predetermined RPM through the driving unit;

storing supplied water in at least one of the storage chambers of the first balancer;

rotating the drum at a third predetermined RPM through the driving unit after supplying water to the first balancer;

sensing, via the signal generator, a magnetic force value of a magnetic force generated by the permanent magnet during rotation of the drum at the third predetermined RPM;

draining the water stored in the first balancer if the sensed magnetic force value is inside the predetermined magnetic force value range; and rotating the drum at the first predetermined RPM through the driving.

6. The method of claim 5, wherein supplying water to the first balancer after rotation of the drum at the second predetermined RPM includes supplying the water through the housing water supply unit to storage chambers of the first balancer provided at a position that is opposite a position of laundry that causes unbalance.

7. The method of claim 6, wherein the third predetermined RPM is lower than the first predetermined RPM.

8. The method of the laundry treating apparatus according to claim 7, wherein the magnetic force value is a voltage signal, and the predetermined magnetic force value range includes a predetermined voltage range.

9. The method of claim 8, further including draining the water stored in the at least one storage chamber of the first balancer if the controller stops the rotation of the drum.

10. The control method of the laundry treating apparatus according to claim 8, wherein draining the water stored in the first balancer includes draining the water stored in the at least one storage chamber via a siphon effect by supplying water to at least one other storage chamber during a rotation of the drum at a fourth predetermined RPM.

11. The method of claim 5, wherein the laundry treating apparatus further comprises a second balancer having a ring shape and fixed to the other of the first and second end of the drum and has a plurality of storage chambers arranged to form the ring shape, the controller further controls a supply and a discharge of water to the second balancer and controls the first balancer and the second balancer independently in accordance with a signal provided by the signal generator while the drum is being rotated, the storage chambers of the second balancer are configured to receive and store water, and the water held in the plurality of storage chambers of the first and second balancers corrects an unbalanced state of the drum, the first balancer and the second balancer are spaced apart by a constant vertical distance regardless of a rotation of the drum, and supplying water to the first balancer after rotation of the drum at the second predetermined RPM includes supplying water to the second balancer, and draining the water stored in the first balancer includes draining the water stored in the second balancer.

12. A method for controlling a laundry treatment apparatus, comprising:

rotating a drum at a first RPM, the drum having a first end;

stopping the drum or rotating the drum at a second RPM in response to an unbalanced state of the drum, the second RPM being less than the first RPM;

supplying fluid to and storing fluid in at least one storage chamber among a plurality of storage chambers arranged to form a first balancer that is fixed to the first end of the drum, each storage chamber being configured to store fluid and including an inlet through which fluid is supplied and an outlet through which fluid is discharged;

after supplying and storing fluid in the at least one storage chamber, rotating the drum at a third RPM;

draining the fluid stored in the at least one storage chamber in response to a balanced state of the drum; and rotating the drum at the first RPM after draining the stored fluid.

13. The method of claim 12, further comprising:

before rotating the drum at the first RPM, washing laundry stored in the drum for a predetermined washing time and draining washing fluid from the drum after the predetermined washing time, and after a predetermined dehydration time after rotating the drum at the first RPM, stopping a rotation of the drum.

14. The method of claim 12, further including, before supplying fluid to and storing fluid in the at least one storage chamber, determining to which at least one storage chamber among the plurality of storage chambers to supply fluid based on a sensed magnetic force, wherein the sensed magnetic force is generated by a plurality of permanent magnets spaced apart at constant intervals corresponding to positions of the plurality of storage chambers.

15. The method of claim 12, wherein the plurality of storage chambers form a ring-shape.

16. The method of claim 12, wherein a plurality of storage chambers are arranged to form a second balancer fixed to a second end of the drum, the second end being opposite to the first end.

17. The method of claim 16, wherein a supply and discharge of fluid to the second balancer is independent from a supply and discharge of fluid to the first balancer.

18. The method of claim 16, wherein the drum rotates around an axis that connects the first and second ends.

19. The method of claim 16, wherein the first and second balancers are spaced apart by a constant vertical distance.

20. The method of claim 12, wherein the storage chambers are configured to store fluid during rotation of the drum, and the storage chambers are configured to discharge stored fluid when the rotation of the drum is stopped or when a pressure difference occurs between a discharge pipe and a pressure inside the storage chambers after fluid in the storage chambers has reached a predetermined fluid level corresponding to an upper end of the discharge pipe.

* * * * *